US007185402B2

(12) United States Patent
Beltz

(10) Patent No.: US 7,185,402 B2
(45) Date of Patent: Mar. 6, 2007

(54) KNIT CLIPS

(76) Inventor: Kelly E. Beltz, 132 Woodhaven Dr., Sarver, PA (US) 16055

( * ) Notice: Subject to any disclaimer, the term of this patent is extended or adjusted under 35 U.S.C. 154(b) by 0 days.

(21) Appl. No.: 11/080,604

(22) Filed: Mar. 15, 2005

(65) Prior Publication Data

US 2006/0207071 A1 Sep. 21, 2006

(51) Int. Cl.
*A44B 21/00* (2006.01)

(52) U.S. Cl. ..... 24/519; 24/67.7; 24/507; 70/37; 70/18

(58) Field of Classification Search ..... 24/519, 24/67.3, 67.5, 67.7, 500, 507; 132/276, 277, 132/278, 279
See application file for complete search history.

(56) References Cited

U.S. PATENT DOCUMENTS 402,778 A 5/1889 Staub
683,286 A * 9/1901 Houser ..... 70/37
2,323,671 A 7/1943 Myslik
4,614,008 A 9/1986 Brill et al.
5,520,201 A * 5/1996 Hart et al. ..... 132/277
5,666,895 A 9/1997 Gehres et al.
D404,525 S * 1/1999 Knudsen ..... D28/42
D415,855 S * 10/1999 Fergusson ..... D28/40
6,223,665 B1 5/2001 Hindsley
6,446,567 B2 9/2002 Hindsley
6,505,487 B1 * 1/2003 Garel et al. ..... 70/18
6,842,951 B1 * 1/2005 Barre et al. ..... 24/499

* cited by examiner

*Primary Examiner*—Robert J. Sandy
*Assistant Examiner*—Marcus Menezes
(74) *Attorney, Agent, or Firm*—James Ray & Assoc.

(57) ABSTRACT

An apparatus for eliminating misaligned rows when securing edges of knitted panels together by securing edges of a pair of panels being darned. The apparatus comprises a first member and a second member each having a handle portion on a first end and a jaw portion on an opposite end. A securing means engaging such first member and such second member intermediate each end thereof for securing such second member to such first member. An aperture is formed through a jaw portion of one of first member and second member and a post member extends outwardly from an inner surface of an opposite one of first member and second member. The post member is disposed to extend through the aperture for securing the panels. A biasing means is engageable with the handle portion of such first member and such second member for biasing the apparatus in a closed position.

19 Claims, 4 Drawing Sheets

KNIT CLIPS

FIELD OF THE INVENTION

The present invention relates, in general, to an apparatus, that assists in knitting and, more particularly, the present invention relates to an apparatus designed to secure knitted and crocheted pieces together so as eliminate misaligned rows.

BACKGROUND OF THE INVENTION

Knitting and crocheting are very popular crafts. These crafts have been popular for a great many years and there are crafting clubs where wares and ideas about these crafts are discussed. One problem that has plagued many of these crafters is keeping the lines straight when darning two pieces together. Frequently some knitting has to be undone because the lines are misaligned. These problems cause the crafter to waste time and energy and creates aggravation for the crafter. Thus, it would be of great benefit to the crafter if there were a means for simply and easily lining up the ends of pieces to be darned so as to eliminate misaligned rows.

SUMMARY OF THE INVENTION

The present invention provides an apparatus which will aid in substantially eliminating misaligned rows when securing adjacent edges of one of knitted and crocheted panels together by securing edges such adjacent edges of a pair of panels of a garment to be darned. The apparatus comprises a first member having a handle portion on a first end and a jaw portion on an opposite end and a second member having a handle portion on a first end and a jaw portion on an opposite end. The second member is engageable with the first member. There is a securing means engageable with such first member intermediate each end thereof and such second member intermediate each end thereof for securing such second member to such first member. An aperture is formed through a jaw portion of one of the first member and the second member and a post like member extends outwardly from an inner surface of an opposite one of such first member and such second member. The post like member is disposed in a position to extend through the aperture for engaging such pair of panels to be darned and securing such panels in place. There is also a biasing means engageable with the handle portion of such first member and such second member for biasing the apparatus in a closed position.

OBJECTS OF THE INVENTION

It is, therefore, one of the primary objects of the present invention to provide an apparatus which can be used while darning seams so as to eliminate misaligned rows.

Another object of the present invention is to provide an apparatus which can be used while darning seams which will save the knitter or crotchetier time, energy and aggravation.

Yet, another object of the present invention is to provide an apparatus which can be used while darning seams which would be easy to use.

Still another object of the present invention is to provide an apparatus which can be used while darning seams which would be inexpensive to manufacture.

In addition to the various objects and advantages of the invention which have been described in some specific detail above it should be noted that various other objects and advantages of the present invention will become more readily apparent to those persons who are skilled in the relevant art from the following more detailed description, particularly, when such description is taken in conjunction with the attached drawing Figures and with the appended claims.

Figure 1:
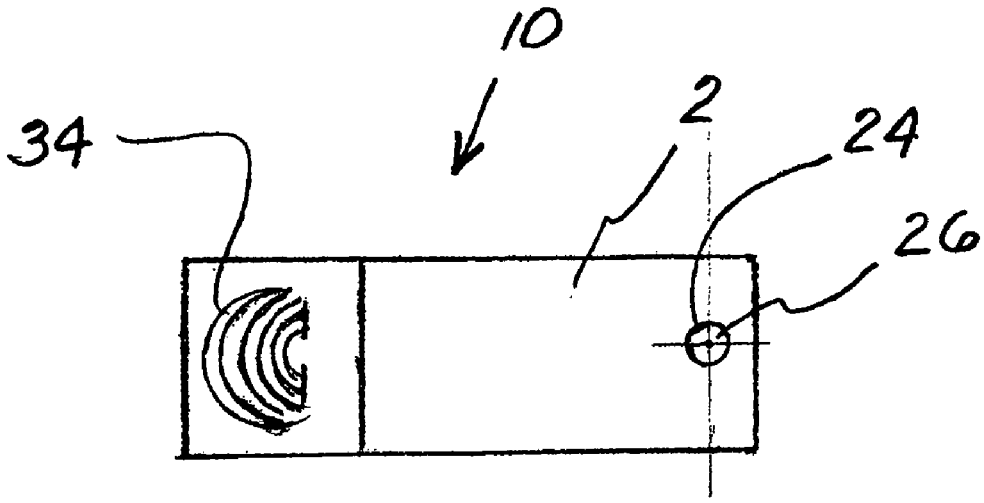
FIG. 1 is a top view of the apparatus according to an embodiment of the invention.
Figure 2:
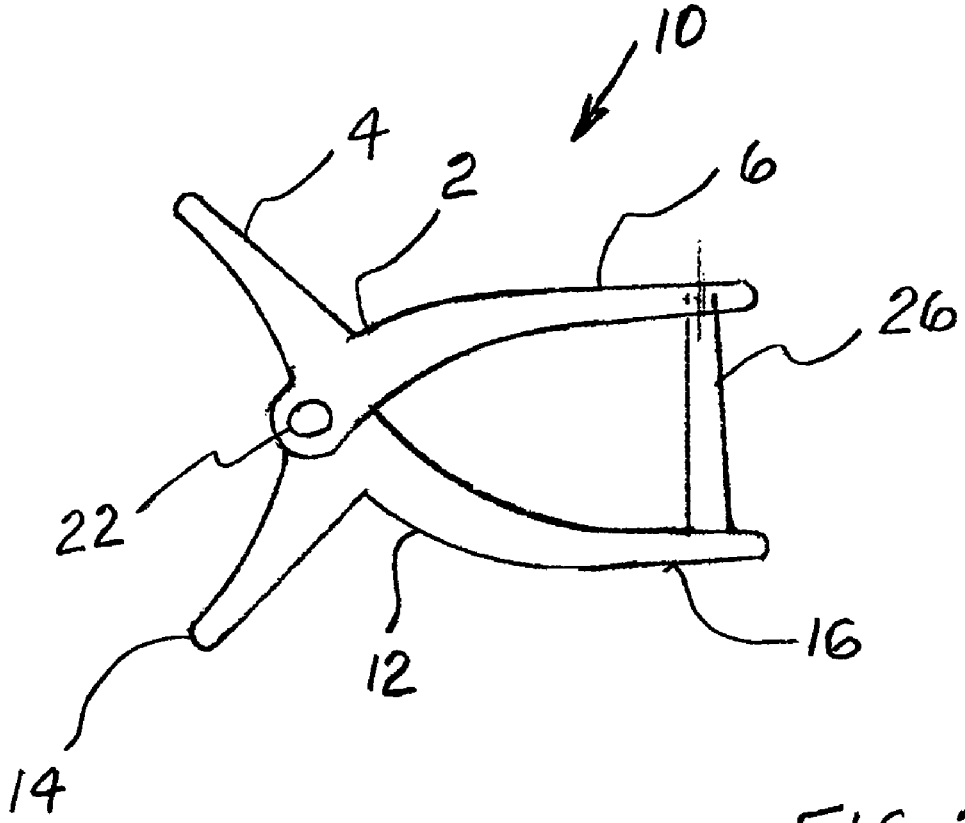
FIG. 2 is a side elevation view of the apparatus according to an embodiment of the invention.

BRIEF DESCRIPTION OF THE PRESENTLY PREFERRED AND VARIOUS ALTERNATIVE EMBODIMENTS OF THE INVENTION

Prior to proceeding to the more detailed description of the invention, it should be noted that identical components having identical functions have been designated with identical reference numerals throughout the several views illustrated in the drawings for the sake of clarity.

Now reference is made, more particularly, to the drawing Figures. Illustrated therein is an apparatus, generally designated 10, according to the present invention. The invention provides an apparatus 10 which will aid in substantially eliminating misaligned rows in knitting and crocheting by securing edges from a pair of panels to be darned.

The apparatus 10 comprises a first member 2 having a handle portion 4 on a first end and a jaw portion 6 on an opposite end and a second member 12 having a handle portion 14 on a first end and a jaw portion 16 on an opposite end. The second member 12 is engageable with the first member 2. There is a securing means 22 engageable with such first member 2 and such second member 12 for securing such second member 12 to such first member 2.

An aperture 24 is formed through a jaw portion of one of the first member 2 and the second member 12 and a post like member 26 extends outwardly from an inner surface of an opposite one of such first member 2 and such second member 12. The post like member 26 is disposed in a position to extend through the aperture 24 for engaging such pair of panels to be darned and securing such panels in place. As the garment is sewn together such apparatus 10 would be removed.

Such post like member 26 is similar to a knitting needle and has a smooth finish so as to avoid snags in the yarn. Such post like member 26 can have a blunt tip or a rounded tip. It is presently preferred that such tip of such post like member 26 be somewhat rounded.

There is also a biasing means 28 engageable with the handle portion 4,14 of such first member 2 and such second member 12 for biasing the apparatus 10 in a closed position. It is presently preferred that such biasing means 28 is a spring 28. Such spring 28 biases such apparatus 10 so that the apparatus 10 is in a closed position. When the handle portions 4,14 are squeezed together the jaw portions 6,16 are forced open and the pieces of a garment to be sewn can be inserted and held in place by the apparatus 10 when the handle members 4,14 are released.

Thus, the apparatus 10 is used to align rows of a knitted or croched garment to make it easier to darn together while virtually eliminating mistakes of a misaligned row. Again, as the seam is sewn together the apparatus 10 would be removed. Such apparatus 10 is designed to accommodate a variety of yarn thicknesses. Also it is within the concept of the invention that a plurality of the apparatus can be used at the same time to hold the ends of the garment together so that the project can be completed faster.

Such securing means 22 of the apparatus 10 is one of a pin and a bolt and it is presently preferred that such securing means 22 be a pin.

As is evident from FIGS. 2,3,5 and 6 such handle portion 4 of the first member 2 and handle portion 14 of such second member 12 are disposed at an obtuse angle, thus, when such handle portions 4,14 of first member 2 and second member 12 are squeezed together the jaw portions 6,16 are opened. The jaw members 6,16 are radially opposed. Illustrated in FIG. 7 is also an alternate embodiment of the invention in which the outer edges of such apparatus 10 are also rounded.

It is also presently preferred that such apparatus 10 be made of plastic. It is also preferred that such apparatus 10 has a length from an end of the handle members 4,14 to the tip of the jaw members 6,16 is between about 1.15 inches and about 1.50 inches. It is presently preferred that such length is about 1.25 inches long.

It is preferred that such post like member 26 is between about ⅜ inch and about ¾ inch in length and it is presently preferred that such post like member 26 is about ½ inches in length.

Figure 3:
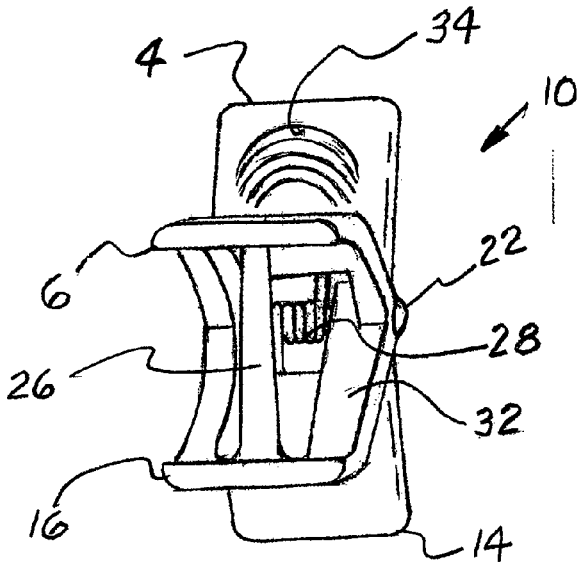
FIG. 3 is a partial perspective front view of the apparatus shown in FIG. 2.
Figure 4:
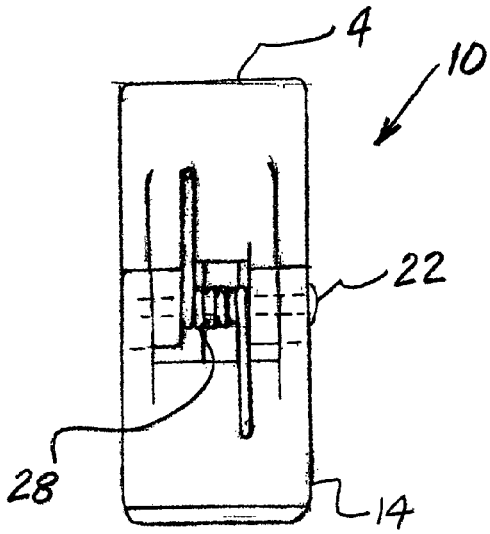
FIG. 4 is a rear view of the apparatus shown in FIG. 2.
Figure 5:
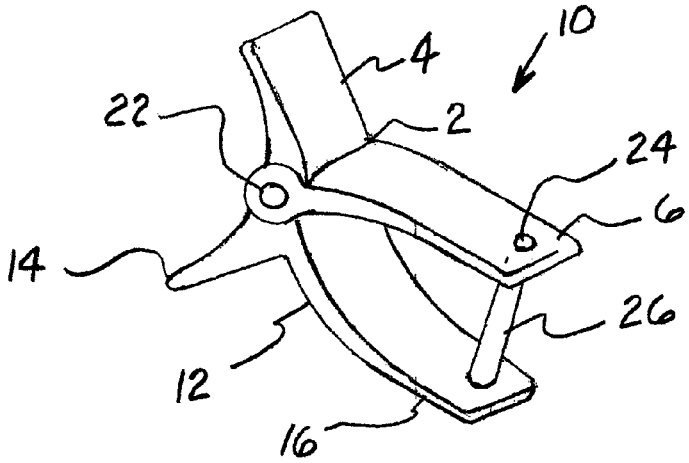
FIG. 5 is a partial perspective view of the apparatus shown in FIG. 2.

AS is evident in FIGS. 1 and 3 such handle portions 4,14 can have grooves 34 on the surface to make the apparatus easier to grip. It is also an embodiment of the invention that such handle portions 4,14 have reinforcing ribs 32 in order to strengthen the handle portions 4,14.

Figure 6:
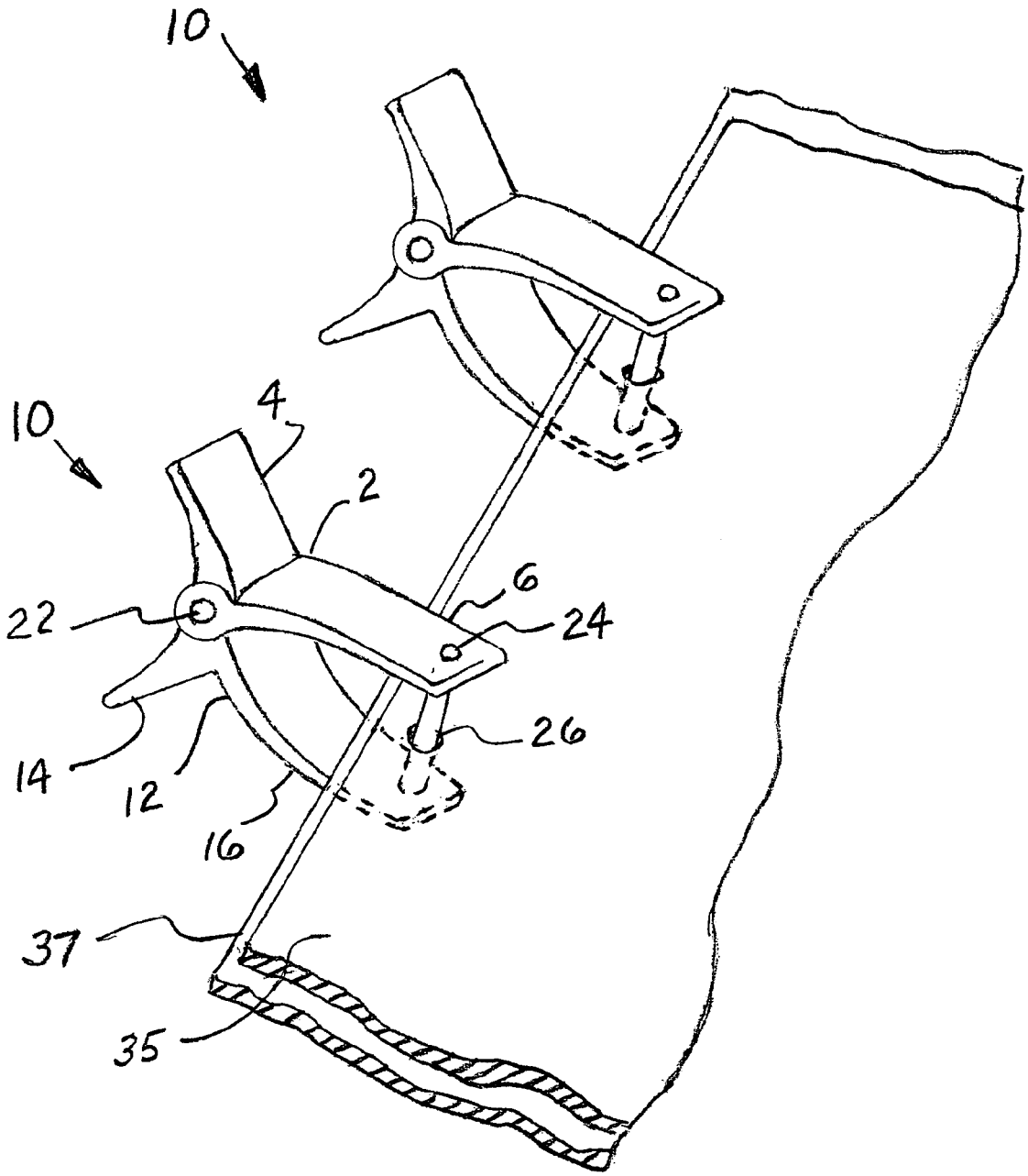
FIG. 6 is a partial perspective view of the apparatus shown in FIG. 2 shown holding edges of garment pieces.
Figure 7:
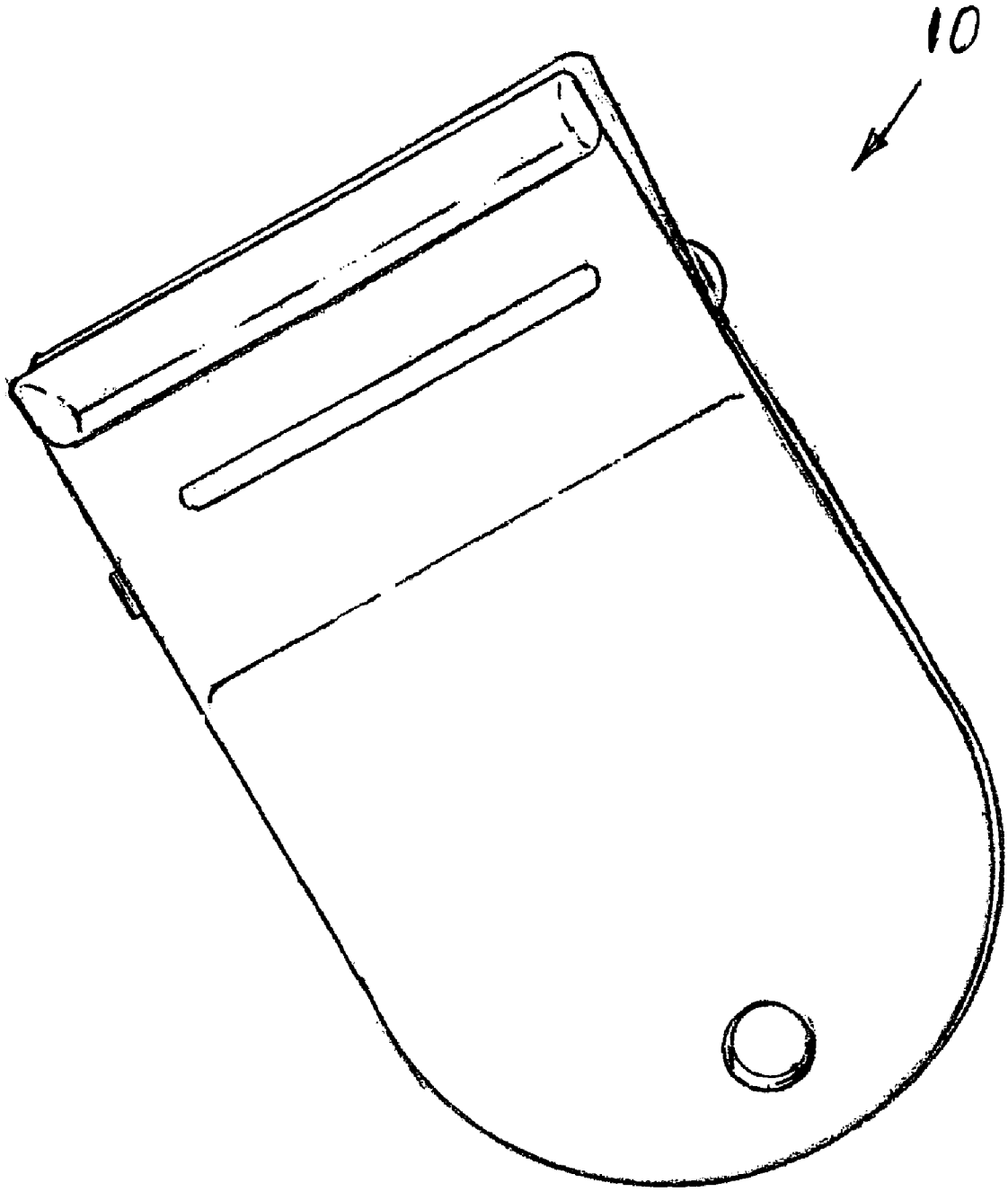
FIG. 7 is a partial perspective top view of the apparatus according to an alternate embodiment of the invention.

Illustrated in FIG. 6 is the apparatus 10 securing two panels 35,37 of a garment so as to keep the lines straight while darning the panels together to form a seam. Thus preventing the lines from being misaligned. Also illustrated in FIG. 6 is the use of more than one apparatus 10 in holding the ends of the panels together so that the seam can be formed much faster.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus which will aid in substantially eliminating misaligned rows when securing adjacent edges of one of knitted and crocheted panels together by securing edges such adjacent edges of a pair of panels of a garment to be darned, said apparatus comprising:

(a) a first member having a handle portion on a first end and a jaw portion on an opposite end;

(b) a second member having a handle portion on a first end and a jaw portion on an opposite end, said second member engageable with said first member;

(c) a securing means engageable with said first member intermediate each end thereof and said second member intermediate each end thereof for securing said second member to said first member;

(d) an aperture formed through a jaw portion of one of said first member and said second member;

(e) a post member extending outwardly from an inner surface of an opposite one of said first member and said second member, said post member disposed in a position to extend through said aperture, said post member for engaging such pair of panels to be darned and securing such panels in place where only said post engages such panels; and (f) a biasing means engageable with said handle portion of said first member and said handle portion of second member for biasing said apparatus in a closed position.

2. The apparatus, according to claim 1, wherein said biasing means is a spring.

3. The apparatus, according to claim 1, wherein said securing means is one of a pin or a bolt.

4. The apparatus, according to claim 3, wherein said securing means is a pin.

5. The apparatus, according to claim 1, wherein said handle portion of said first member and said handle portion of said second member are disposed at an obtuse angle.

6. The apparatus, according to claim 5, wherein said handle portion of said first member and said handle portion of said second member are squeezed together so as to open said jaw portions of said first member and said second member.

7. The apparatus, according to claim 1, wherein said apparatus is made of plastic.

8. The apparatus, according to claim 1, wherein said apparatus has a length from an end of said handle member to a tip of said jaw member is between about 1.15 inches and about 1.50 inches.

9. The apparatus, according to claim 8, wherein said apparatus is about 1.25 inches long.

10. The apparatus, according to claim 1, wherein said post member is between about ⅜ inch and about ¾ inch in length.

11. The apparatus, according to claim 1, wherein said post member is about ½ inches in length.

12. The apparatus, according to claim 1, wherein a plurality of said apparatus can be used to hold such ends of such panels to be sewn together so that a seam can be formed much faster.

13. The apparatus, according to claim 1, wherein said apparatus can accommodate a variety of yarn thicknesses.

14. The apparatus, according to claim 1, wherein said post member has a smooth finish so as to avoid snags in such yarn being sewn.

15. The apparatus, according to claim 1, wherein said jaw portion of said first member and said jaw portion of said second member are radially opposed.

16. The apparatus, according to claim 1, wherein said post member includes one of a blunt tip or a rounded tip.

17. The apparatus, according to claim 16, wherein said post member includes a rounded tip.

18. The apparatus, according to claim 1, wherein an outer surface said handle portion of said first member and said outer surface of said handle portion of said second member is grooved.

19. The apparatus, according to claim 1, wherein said handle portion of said first member and said handle portion of said second member have reinforced ribs.

* * * * *